United States Patent [19]

Dickenson

[11] 4,353,216

[45] Oct. 12, 1982

[54] FORWARD-REVERSE FLOW CONTROL SYSTEM FOR A BYPASS STEAM TURBINE

[75] Inventor: Royston J. Dickenson, Scotia, N.Y.

[73] Assignee: General Electric Company, Schenectady, N.Y.

[21] Appl. No.: 192,324

[22] Filed: Sep. 29, 1980

[51] Int. Cl.[3] ..... F01K 13/02

[52] U.S. Cl. ..... 60/662; 60/646; 60/657; 60/652

[58] Field of Search ..... 60/660, 662, 646, 657, 60/663, 677, 679, 652

[56] References Cited

U.S. PATENT DOCUMENTS

| | | | |
|---|---|---|---|
| 4,118,935 | 10/1978 | Andersson | 60/662 |
| 4,132,076 | 1/1979 | Weiss | 60/646 |
| 4,201,924 | 5/1980 | Uram | 60/660 X |
| 4,309,873 | 1/1982 | Koran et al. | 60/662 |

OTHER PUBLICATIONS

Vol. 35, Proceedings of the American Power Conference, "Bypass Stations for Better Coordination between Steam Generator Operation", Martin et al., May 1973.

*Primary Examiner*—Allen M. Ostrager

*Attorney, Agent, or Firm*—Ormand R. Austin; John F. Ahern

[57] ABSTRACT

A solution to the problem of excessive rotation loss heating in a bypass steam turbine has been provided by the introduction of a reverse flow of steam to the high-pressure section of the turbine during those operating periods in which such heating is of concern. The present invention is directed to a control system for automatically selecting either the forward or reverse steam flow regime as is most appropriate, depending on turbine and other related operating conditions. In a preferred embodiment, the control system includes means for selecting either a forward or reverse flow control signal to govern the steam admission control valves; means for controlling the reverse flow valve and having decisional logic for determining whether the reverse flow valve shall be open or closed; and means for controlling the ventilator valve and having decisional logic for determining whether the ventilator valve shall be open or closed.

16 Claims, 2 Drawing Figures

FORWARD-REVERSE FLOW CONTROL SYSTEM FOR A BYPASS STEAM TURBINE

This invention relates to control systems for steam turbines, and more particularly to control systems for steam turbines operable in the steam bypass mode.

BACKGROUND OF THE INVENTION

The bypass mode of operating a steam turbine, although advantageous in many respect, presents a unique set of problems as this mode of operation is extended to those turbines at the larger end of the size spectrum. In particular, at low-load (including no-load) operating conditions, the larger machines encounter a problem known variously as "windage loss heating" or as "rotation loss heating". This kind of heating is most likely to occur at the exhaust end of the high pressure section of the turbine as a result of the combination of high backpressure at that point from the bypass steam flow and the relatively low flow of steam through the turbine's high pressure section. Windage loss heating, if uncontrolled, may increase the steam temperature to excessive levels and is, therefore, potentially damaging to the turbine.

In U.S. patent application Ser. No. 105,019, now U.S. Pat. No. 4,309,873, which is assigned to the assignee of the instant application, K. W. Koran and W. T. Parry disclose and claim a method and apparatus for preventing rotation loss heating. According to their method, a reverse flow of steam is provided through the high pressure section of the turbine so that windage losses are taken away by cooling steam flow. The reverse flow of steam is preferably taken from the high pressure bypass line just ahead of the steam reheater and is then passed backwards through the turbine's high pressure (HP) section from the last stages through the first stage. The reverse steam flow path includes a reverse flow valve to admit the cooling steam to the HP section and a ventilator valve connected to discharge the cooling steam from the HP section. The control valves through which steam is admitted to the turbine in the conventional, forward flow direction must, of course, be closed when the reverse flow path is used.

During the reverse flow regime, admission of steam to the lower pressure sections of the turbine provide the forward driving energy to sustain whatever load may be applied. By proper balance of steam flow, the reverse flow technique is effective to eliminate excessive windage loss heating in the lower pressure (LP) sections of a turbine as well as in the high pressure section.

At some point during turbine operation, when load on the turbine has been increased to the point at which steam flow in the forward direction of the high pressure section can be established without excessive temperatures in either the HP or LP sections, the ventilator valve is closed and the admission control valves are opened.

The transfer from one steam flow regime to the other requires knowledge of turbine operating parameters and an exercise of judgement, based on the operating parameters, as to when the transfer in steam flow direction can most effectively be made. A transfer which is either late or premature is undesirable from considerations of both operating efficiency and minimization of chances of overheating damage to the machine.

Thus, it is a principal objective of the present invention to provide a control system for ascertaining certain preselected operating conditions of the turbine and for automatically transferring to either a forward or a reverse steam flow through the high pressure section thereof depending on the status of such conditions.

SUMMARY OF THE INVENTION

The control system according to the present invention controls the reverse flow valve, the ventilator valve, and the admission control valving of a bypass steam turbine so that forward or reverse steam flow through the high pressure section of the turbine is automatically selected depending on turbine operating parameters. The selection is made in a manner to prevent damage to the turbine from rotation loss heating.

In a preferred embodiment, the control system includes a first automatic means having logic for selecting either a forward or reverse flow control signal to govern the admission control valving so that the forward flow signal governs only whenever a set of preselected operating conditions are satisfied; a second automatic means for controlling operation of the reverse flow valve and having decisional logic means to determine whether the reverse flow valve shall be in the open or closed position depending upon turbine and other related operating conditions; and a third automatic means for controlling operation of the ventilator valve and having logic means to determine whether the ventilator valve shall be in the open or closed position depending also on turbine and other related operating conditions. In addition to automatic control, provision is made for manually selecting the forward flow of steam whenever operating conditions will permit.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

A large steam turbine with its control system and many subsystems for monitoring and for ensuring personnel and equipment protection is a very complex and complicated piece of equipment. Therefore, in describing and illustrating the present invention, only those portions of the total turbine-generator system necessary to an understanding of the invention are presented. Simplifications are made where possible to aid an understanding of the principles and operation of the invention.

Figure 1:
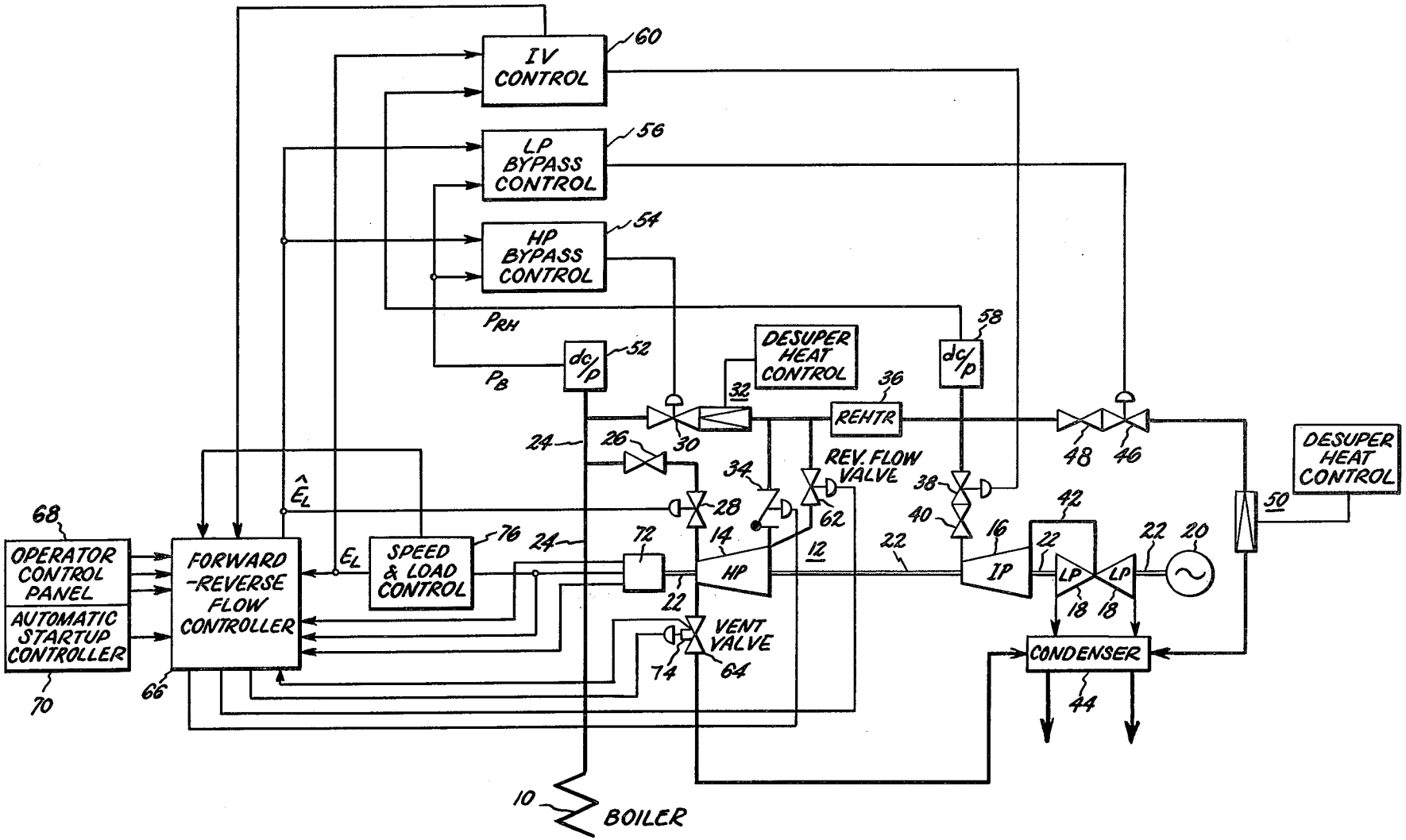
FIG. 1 is a simplified schematic diagram of a turbine-generator set including a bypass steam turbine adapted for forward or reverse steam flow through the turbine high pressure section and illustrating the operational interconnections of the control system of the present invention with the turbine and the overall control system therefor.

Referring now to FIG. 1, there is shown an electrical power generating plant in which a boiler 10 serves as the source of high pressure steam, providing the motive fluid to drive a reheat steam turbine 12 which includes high pressure (HP) section 14, intermediate pressure (IP) section 16, and low pressure (LP) section 18. Although this is conventional nomenclature, at times herein the IP section 16 and LP section 18 may be grouped together and referred to as the lower pressure (LP) sections of the turbine. In the like manner, the bypass subsystem (described herein below) which passes steam around these sections may be referred to as the lower pressure or LP bypass subsystem. Although the turbine sections 14, 16, and 18 are illustrated to be tandemly coupled to generator 20 by shaft 22, other coupling arrangements may be utilized.

The steam flow from boiler 10 is through steam conduit 24, from which steam may be taken to HP turbine 14 through main stop valve 26 and admission control valve 28. A high pressure bypass subsystem including HP bypass valve 30 and desuperheating station 32 provides an alternative or supplemental steam path around HP section 14. It will be recognized that, although one HP bypass subsystem is illustrated, other parallel bypass paths each including a flow control valve, may also be utilized. In any case, steam flow exhausting from HP turbine 14 passes through check valve 34 to rejoin any bypassed steam and the total flow then passes through reheater 36. From reheater 36, steam may be taken through the intercept valve 38 and reheater stop valve 40 to the IP turbine 16 and LP turbine 18 which are series connected in the steam path by conduit 42. Steam exhausted from the LP turbine 18 flows to condenser 44. A lower pressure (LP) bypass subsystem including LP bypass valve 46, LP bypass stop valve 48, and desuperheating station 50 provides an alternative or supplemental steam path around IP turbine 16 and LP turbine 18 to condenser 44.

Control of steam flow in both the HP and LP bypass subsystems by throttling bypass valves 30 and 46, respectively, is preferably in a manner which is related to boiler pressure and steam flow from the boiler. Accordingly, an HP bypass control loop and an LP bypass control loop provide such control. The HP control loop includes first pressure transducer 52 and HP bypass controller 54; the LP bypass control loop also includes first pressure transducer 52 as well as LP bypass controller 56.

Control of the intercept valve, on the other hand, is preferably related to reheater steam pressure. Thus an intercept valve control loop is provided which comprises second pressure transducer 58 and intercept valve controller 60.

A comprehensive control system for a bypass steam turbine which is usable in connection with the present invention is that described and claimed in copending U.S. patent application Ser. No. 184,359 which is of common assignee and inventorship with the instant invention and whose disclosure is incorporated herein by reference thereto. Thus in illustrating the present invention in FIG. 1, turbine demand signal $E_L$ and admission control valve position signal $\hat{E}_L$ are provided as additional inputs to the intercept and bypass control loops in conformity with the control system of the aforesaid patent application.

Associated with the HP section 14 of turbine 12, and principally used for no-load and low-load operating conditions, are reverse flow valve 62 and ventilator valve 64. These valves, 62 and 64, are used to provide a reverse flow of steam through the HP turbine in the manner disclosed and claimed in the above cited U.S. Pat. No. 4,309,873, the disclosure of which is incorporated herein by reference. The reverse steam flow eliminates rotation loss (windage loss) heating which occurs under certain low-load conditions of the type associated with the bypass mode of operation. Windage loss heating is controlled by admitting a portion of the high-pressure bypass steam to the lower pressure sections 16 and 18 of the turbine in sufficient quantity to provide motive fluid for driving the turbine. Simultaneously, a second portion of the steam bypassed around the high pressure section is admitted to the high pressure section 14 of the turbine in a reverse-flow direction to pass backwards therethrough. In other words, the turbine is driven entirely by the portion of the HP bypass steam admitted to the lower pressure sections 16 and 18 of the turbine while a second portion of the HP bypass steam is admitted in reverse-flow to the HP section 14 of the turbine to create a braking and cooling effect. The flows are porportioned to prevent overheating in both the HP and LP sections.

Reverse flow valve 62 is provided to admit the reverse flow, or cooling steam, to the HP section 14 of the turbine and ventilator valve 64 is provided to discharge the cooling steam to the atmosphere or to the condenser associated with the turbine.

When load on the turbine has been increased to the point at which steam flow in the forward direction of the HP section can be established without excessive temperatures in either the HP or LP sections, the ventilator valve is closed and the conventional control valve will open. This valving action preferably occurs in a relatively short time, i.e., a matter of seconds. The present invention is directed to a control system for controlling the steam directional flow valves (i.e., valves 28, 62, and 64) so that the direction of steam flow in HP section 14 of the turbine is automatically established.

FIG. 1 illustrates a preferred arrangement of such a control system. For example, forward-reverse flow controller 66 provides operative control signals to the admission control valve 28, to reverse flow valve 62, and to ventilator valve 64 to determine the positioning of these valves depending on whether preselected turbine operating conditions are satisfied. Additionally, in one form of the invention, controller 66 provides a closing bias signal to check valve 34 under certain conditions so that it may be positively seated and may be closed against relatively small residual pressures in HP section 14. Without application of the closing bias signal, check valve 34 operates as a conventional check valve and is opened or closed by steam pressure differentials.

In the conventional forward flow regime, ventilator valve 64 is held closed, admission control valve 28 is positioned in accordance with the valve positioning signal $E_L$ ($E_L$ and $\hat{E}_L$ are identical when steam flow in the forward direction), and reverse flow valve 62 may be opened or closed depending on turbine speed and the ventilator valve position. Reverse flow valve 62 and ventilator valve 64 preferably have no intermediate positions and are either fully opened or fully closed.

The forward-reverse flow controller 66 is interactive with an operator control panel 68 through which operating personnel may impose certain preconditions or operating constraints on the forward-reverse flow controller 66. For example, in one form of the invention, operating personnel may direct, through the control panel 68, that valves 28, 62, and 64 be in position for prewarming the turbine. Additionally, the control panel 68 may be used to manually inform the forward reverse controller 66 that the bypass systems are "out of operation" so that the turbine is operable in a conventional mode. Further, the operator can direct that steam flow be in the forward direction through the HP section 14 whenever other conditions are satisfied. These operator imposed signals are discussed more fully herein below in connection with FIG. 2.

Automatic startup controller 70 also interacts with the forward-reverse flow controller 66 and provides a permissive signal (based on thermal and mechanical stress and other turbine operating parameters) which allows the forward-reverse flow controller 66 (if other conditions are satisfied) to cause steam flow to be in the forward direction. Automatic startup controller 70 per se is not a material part of the present invention but is of the type known in the art for automatically advancing a turbine safely through its startup steps while avoiding excessive thermal and mechanical stress. Automatic startup controller 70 may, for example, be of the type disclosed and claimed in U.S. patent application Ser. No. 157,348 to Kure-Jensen et al which application is assigned to the assignee of the present invention and the disclosure of which is hereby incorporated herein by reference. Within the context of the present invention, it is sufficient to note that automatic startup controller 70 supplies a permissive signal to allow forward-reverse flow controller 66 to switch from the reverse steam flow regime to the forward steam flow regime only when it can be achieved without causing high thermal stresses in the turbine. The permissive signal thus supplied by automatic startup controller 70 may, for example, simply be a switch contact closure causing application of a proper logic signal.

Other inputs to forward-reverse flow controller 66 include triply redundant turbine speed signals from shaft speed transducers 72; a signal indicative of ventilator valve position from position transducer 74 (mounted on ventilator valve 64); an emergency trip signal from turbine speed and load control 76; a turbine demand signal $E_L$ indicative of the turbine's requirement for steam to sustain preset speed and load; and an intercept valve demand signal from intercept valve controller 60. The intercept valve demand signal is proportional to steam flow through the LP sections 16 and 18 of the turbine 12 and inversely proportional to pressure in reheater 36. Admission control valve positioning signal $\hat{E}_L$ supplied by forward-reverse flow controller 66 is identical to the turbine demand signal $E_L$ when steam flow is in the forward direction but is selected to force admission control valve 28 closed, when steam flow is in the reverse direction. Thus it is one function of the forward-reverse flow controller 66 to select the signal according to which admission control valve 28 is positioned. Generally, however, forward-reverse flow controller 66 manipulates valves 28, 34, 62, and 64 so that a forward flow of steam is automatically selected when the turbine is loaded sufficiently to avoid excessive rotation loss heating and to select a reverse flow of steam when under load conditions that lead to such heating.

Figure 2:
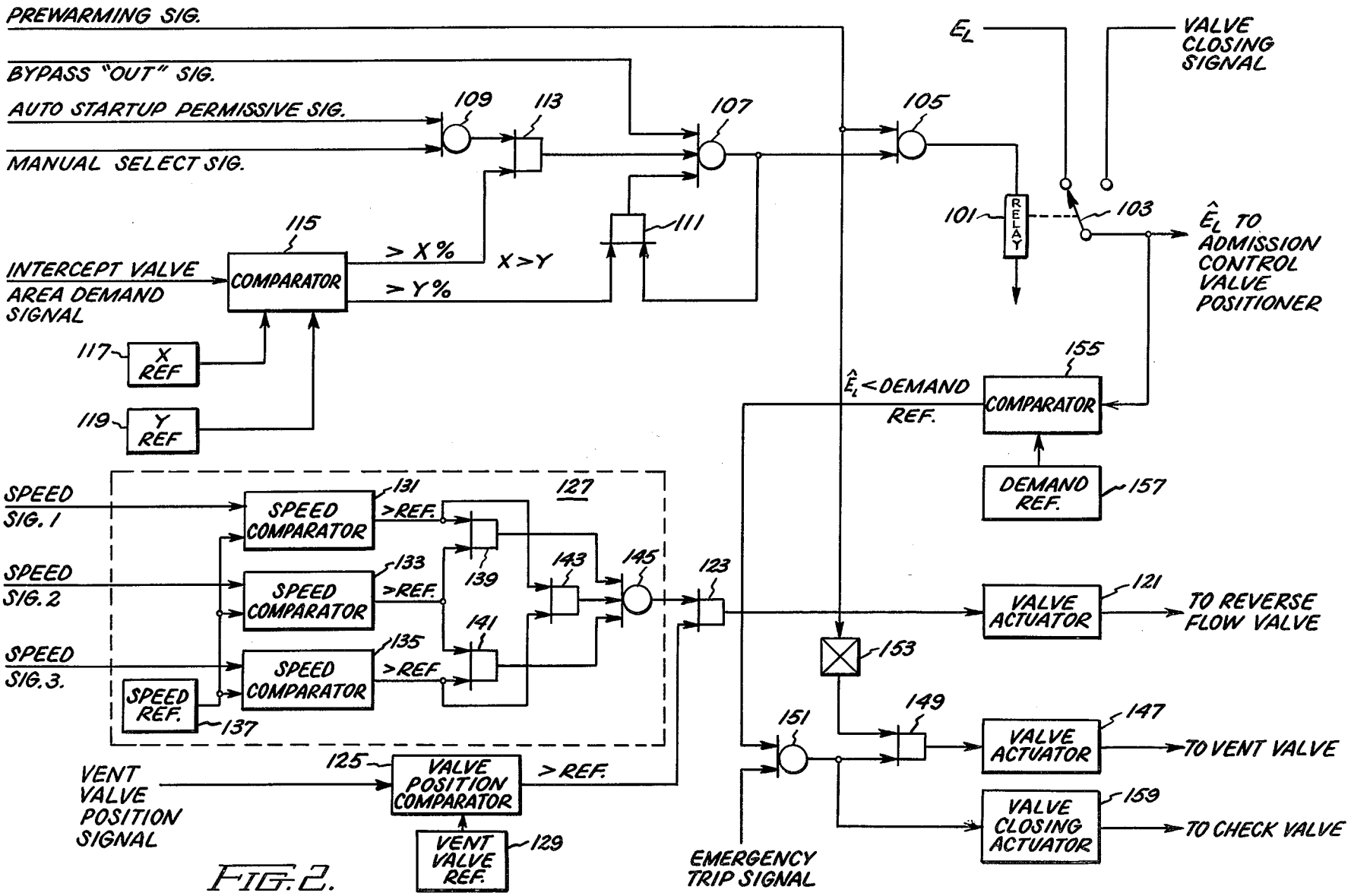
FIG. 2 is a schematic diagram of a preferred embodiment of a forward-reverse flow controller for the present control system, which embodiment is suitable for use with the bypass turbine of FIG. 1.

Referring now to FIG. 2 which illustrates a preferred embodiment of the forward-reverse flow controller 66 of FIG. 1 in detail, relay 101, which includes switching contact 103, is an automatic means, operated by associated logic circuitry, to select the signal which is to control the admission control valving. Thus with contact 103 in the position shown, $E_L$ and $\hat{E}_L$ are identical and the admission control valving is operated according to the turbine demand signal $E_L$ as supplied by the speed and load controller 76 of FIG. 1. Relay contact 103 is in the position shown in FIG. 2 whenever relay 101 is activated and whenever a preselected set of operating conditions are satisfied as determined by the logic circuitry which drives relay 101. Relay 101 is thus required to be closed for a forward flow of steam. On the other hand, if relay 101 is not activated, indicating that the preselected set of operating conditions are not satisfied, relay contact 103 ties the admission control valve line to a valve closing signal and the admission control valve is thereby forced closed. This is the situation for a reverse flow of steam. Thus relay 101 is forced to select either a forward flow control signal $E_L$ or a reverse flow control signal, the latter of which forces the admission control valve closed.

The logic circuitry associated with relay 101 and the selection of the admission control valve positioning signal includes OR gates 105, 107, and 109; AND gates 111 and 113; and comparator 115 having first and second demand reference value inputs from X and Y set point units 117 and 119, respectively. The X and Y values are in terms of percentage of the maximum demand value. Logic symbols used in FIG. 2 are NEMA standard symbols.

The set of preselected conditions required to activate relay 101, includes three signals from an operator control panel such as that illustrated in FIG. 1. These signals include a prewarming signal which is applied directly to one input of OR gate 105; a "bypass out" signal which is applied to one input of OR gate 107; and a manual select signal which is applied to an input of OR gate 109. The manual select signal may be regarded as a permissive signal, based on the operator's judgment, that allows selection of the forward flow control signal $E_L$ to be applied for admission control valve positioning, assuming other conditions, described below, are satisfied. If either the prewarming or "bypass out" signal is applied, relay 101 is activated and the admission control valve responds to $E_L$, permitting the forward flow of steam. On the other hand, the manual select signal, while applied to OR gate 109 must also satisfy AND gate 113 before relay 101 is activated. A parallel input to OR gate 109 is applied from a turbine automatic startup controller in the manner described above and thus has the same effect as a manual select input signal and may be regarded as a second permissive signal for forward steam flow. The "bypass out" signal is indicative that the turbine is being operated in a conventional mode (without the bypass subsystems) and application of this signal holds relay 101 in the forward steam flow position. The prewarming signal also holds relay 101 in a forward flow position so that the admission control valve is responsive as the turbine is being prewarmed for a startup.

AND gate 113, in addition to receiving an input from OR gate 109 also receives a signal from comparator 115 whenever the intercept valve demand signal is greater than a preselected reference value X which is supplied by set point unit 117. The intercept valve demand signal which is compared with preselected demand reference values X and Y in comparator 115, is taken from the control loop which controls the positioning of the intercept valve 38 as illustrated in FIG. 1. The intercept valve demand signal is indicative of the degree of opening of the intercept valve and of the demand for steam flow therethrough. Therefore, with the intercept valve demand sufficiently great (greater than demand reference value X) and with either a manual select signal or a permissive signal from an automatic startup controller, AND gate 113 is activated, in turn to activate relay 101.

AND gate 111 in combination with the Y output of comparator 115 form a latch to hold relay 101 energized. Thus with the intercept valve demand greater than reference value Y and with OR gate 107 having been energized, AND gate 111 latches OR gates 107 and 105 and relay 101 until the intercept valve demand drops below the Y reference level.

Operation of the reverse flow valve (reference 62 of FIG. 1) is by reverse flow valve actuator 121 which in turn is controlled by logic circuitry which allows the reverse flow valve to be actuated (opened) only if the speed of the turbine is greater than a preselected speed, and if the ventilator valve is opened. Operation of valve actuator 121, then, is determined by AND gate 123 having inputs from ventilator valve position comparator 125 and 2 out of 3 shaft speed detector network 127. A ventilator valve position signal is supplied by a ventilator valve position transducer 74 (illustrated in FIG. 1) to comparator 125 wherein the valve position is compared with a preset reference value supplied by ventilator valve reference unit 129. A signal appropriate to actuate AND gate 123 is supplied by valve position comparator 125 only when the ventilator valve is sufficiently open. Thus the reverse flow valve is caused to be open only when turbine speed is above a preselected value and the ventilator valve is sufficiently open.

The 2 out of 3 speed detector network 127 supplies a signal appropriate to activate AND gate 123 only if at least 2 out of the 3 input signals indicative of turbine shaft speed are above a preselected minimum speed. Speed detector network 127 includes speed comparators 131, 133, and 135; speed reference unit 137 by which the minimum speed may be selected; AND gates 139, 141, and 143; and OR gate 145. Preferably, the three input speed signals are derived from three separate speed transducers.

Operation of the ventilator valve (reference 64 of FIG. 1) is by ventilator valve actuator 147 which is controlled by logic circuitry including AND gate 149, OR gate 151, inverter 153, and demand comparator 155 having demand reference unit 157. The logic circuitry for the ventilator valve thus causes actuator 147 to open the ventilator valve permitting a reverse flow of steam if the turbine is not being prewarmed and the turbine load is at the lower load levels at which windage loss heating is a problem. An indication of such lower load levels occurs whenever admission control valve positioning signal $\hat{E}_L$ is less than a preselected value.

Alternatively, the ventilator valve is caused to be opened if an emergency tripout has occurred and assuming the ventilator valve is not held closed for turbine prewarming operations. The emergency trip signal is indicative that the admission control valves have been very rapidly closed to shut off the steam supply to the turbine and preferably will be taken from the hydraulic system (not illustrated herein) which is used to operate such control valves.

To insure that check valve 34 of FIG. 1 is positively seated and that it has some positive closing force at the proper time, it is preferably provided with a closing actuator (as is well known in the art) by which a closing bias force may be applied. Thus, valve closing actuator 159, shown in FIG. 2, is actuated by OR gate 151 to apply a closing bias to the check valve whenever an emergency trip condition occurs or whenever the admission control valve position signal $\hat{E}_L$ is less than a preselected value. It will be recognized, however, that automatic selection of forward or reverse flow through HP section 14 (FIG. 1) may still be effected if check valve 34 is without a closing bias actuator.

The foregoing has described a control system for automatically selecting either forward or reverse steam flow through the high pressure section of a steam turbine as is appropriate for protection of the turbine against excessive windage loss heating and for gaining efficient turbine operation. It will be appreciated by those of skill in the art that while a preferred form of the invention has been described in detail, modifications may be made in that form without detracting from the true spirit and scope of the invention. For example, although the invention has been described to operate the reverse flow valve as a function of turbine speed, other turbine operating parameters may also be utilized to determine such valve operation. Further it will be readily recognized that the various logic circuitry specifically set forth herein may be provided with additional inputs or conditions other than those which have been described for causing operation of the controlled valves. Still further, it will be recognized that the invention may be implemented with control and circuit elements which are either electrical, hydraulic, fluidic, or pneumatic and which may be either analog or digital in nature. Thus, while the present invention has been disclosed in connection with a preferred embodiment thereof, it should be understood that there may be other embodiments which fall within the spirit and scope of the invention as defined by the following claims.

The invention claimed is:

1. In combination with a steam turbine having a high pressure (HP) section, at least one lower pressure (LP) section, a steam conduit interconnecting the HP section of the LP section through a steam reheater, at least one admission control valve, at least one intercept valve, an HP bypass subsystem, an LP bypass subsystem, a reverse flow valve, and a ventilator valve, a control system for controlling said reverse flow valve, said ventilator valve, and said admission control valve to automatically select forward or reverse steam flow through said HP section, said control system comprising:

first automatic means for selecting the control signal according to which said admission control valve is positioned, said first means including first logic means to cause selection of a forward flow control signal whenever a first set of preselected operating conditions is satisfied and to cause selection of a reverse flow control signal forcing said admission control valve closed whenever said first set of preselected operating conditions is not satisfied;

second automatic means for controlling the operation of said reverse flow valve, said second means including second logic means to cause said valve to be opened only whenever a second set of preselected turbine operating condition is satisfied; and third automatic means for controlling the operation of said ventilator valve, said third means including third logic means to cause said valve to be opened only whenever a third set of preselected turbine operating conditions is satisfied.

2. The combination of claim 1 wherein:

said first logic means is adapted to receive a first permissive signal and a demand signal indicative of the degree of opening of said intercept valve; and said first logic means includes means to cause selection of said forward flow control signal whenever said demand signal exceeds a first preselected demand reference value and said first permissive signal is received.

3. The combination of claims 1 or 2 wherein said second logic means is adapted to cause said reverse flow valve to be open whenever a preselected turbine speed is exceeded and said ventilator valve is in an open position.

4. The combination of claims 1 or 2 wherein said third logic means is adapted to cause said ventilator valve to be open whenever said admission control valve is demanded open less than a preselected amount and the turbine is not in a prewarming operating condition.

5. The combination of claim 3 wherein said third logic means is adapted to cause said ventilator valve to be open whenever said admission control valve is demanded open less than a preselected amount and the turbine is not in a prewarming operating condition.

6. The combination of claim 5 wherein said first logic means includes means to cause retention of said forward flow control signal by said first automatic means after said forward flow control signal has been initially selected and so long as said demand signal continuously exceeds a second preselected demand reference value, said second demand reference value being less than said first demand reference value.

7. The combination of claim 6 wherein said second logic means is adapted to cause said reverse flow valve to be open by including in said second logic means a 2 out of 3 redundant speed detection means for determining when said preselected turbine speed is exceeded.

8. The combination of claim 7 wherein said first logic means is adapted to receive a signal indicative that the turbine is being prewarmed and to cause selection of said forward flow control signal whenever said signal is received.

9. The combination of claim 8 wherein said first logic means is adapted to receive a second permissive signal and includes means to cause selection of said forward flow control signal whenever said demand signal exceeds a first preselected demand reference value and said first permissive signal or said second permissive signal is received.

10. The combination of claim 9 wherein said first permissive signal is manually selectable.

11. The combination of claim 10 wherein said second permissive signal is automatically selected by an automatic turbine startup controller.

12. A control system for automatically selecting forward or reverse steam flow in the high pressure (HP) section of a bypass steam turbine having at least one admission control valve for the admission of steam in a forward flow direction through the HP section, a reverse flow valve for the admission of steam in a reverse flow direction through the HP section, a ventilator valve for exhausting steam from the HP section, and an intercept valve for the admission of steam to lower pressure (LP) sections of the turbine, said control system comprising:

first means for selecting the control signal according to which said admission control valve is positioned, said first means including first logic means to select a reverse flow control signal forcing said valve closed whenever the turbine is operating under load conditions productive of excessive rotation loss heating within the turbine and to select a forward flow control signal to position said valve according to load and speed control demands whenever the turbine is operating under load conditions not productive of excessive rotation loss heating;

second means for operating said reverse flow valve, said second means including second logic means to cause said reverse flow valve to be open whenever the turbine is operating at a speed in excess of a preselected speed; and third means for operating said ventilator valve, said third means including third logic means to cause said ventilator valve to be open whenever the turbine is operating under load conditions productive of excessive rotation loss heating within the turbine.

13. The control system of claim 12 wherein said first logic means is adapted to receive a first permissive signal and a demand signal indicative of the degree of opening of said intercept valve and to cause selection of said forward flow control signal so long as said demand signal exceeds a first preselected reference value and said first permissive signal is being received.

14. The control system of claim 13 wherein said third logic means is adapted to cause said ventilator valve to be open so long as said admission control valve is demanded open less than a preselected amount.

15. The control system of claim 14 wherein said first logic means is adapted to cause selection of said forward flow control signal at all times after its initial selection and so long as said demand signal exceeds a second preselected reference value, said second reference value being less than said first reference value.

16. A control system for automatically selecting forward or reverse steam flow in the high pressure (HP) section of a bypass steam turbine having at least one admission control valve for the admission of steam in a forward flow direction through the HP section; a reverse flow valve for the admission of steam in a reverse flow direction through the HP section, a ventilator valve for exhausting steam from the HP section, an intercept valve for the admission of steam to lower pressure (LP) sections of the turbine, and a check valve fluidly connected in parallel with the reverse flow valve, said control system comprising:

first means for selecting the control signal according to which said admission control valve is positioned, said first means including first logic means to select a reverse flow control signal forcing said valve closed whenever the turbine is operating under load conditions productive of excessive rotation loss heating within the turbine and to select a forward flow control signal to position said valve according to load and speed control demands whenever the turbine is operating under load conditions not productive of excessive rotation loss heating;

second means for operating said reverse flow valve, said second means including second logic means to cause said reverse flow valve to be open whenever the turbine is operating at a speed in excess of a preselected speed;

third means for operating said ventilator valve, said third means including third logic means to cause said ventilator valve to be open whenever the turbine is operating under load conditions productive of excessive rotation loss heating within the turbine; and fourth means for applying a closing force bias to said check valve whenever said admission control valve is demanded closed.

* * * * *